United States Patent [19]

Eronini

[11] 4,427,017

[45] Jan. 24, 1984

[54] HAIR BRAIDER

[76] Inventor: Iheanyichukwu E. Eronini, 1728 Taylor St., NW., Washington, D.C. 20011

[21] Appl. No.: 308,674

[22] Filed: Oct. 5, 1981

[51] Int. Cl.[3] ..... A45D 1/00

[52] U.S. Cl. ..... 132/9

[58] Field of Search ..... 132/5, 7, 9, 11 A

[56] References Cited

U.S. PATENT DOCUMENTS

| | | | |
|---|---|---|---|
| 3,903,905 | 9/1975 | Tucker | 132/9 |
| 3,955,064 | 5/1976 | Demetrio et al. | 132/7 |
| 4,038,996 | 8/1977 | Eronini et al. | 132/9 |

*Primary Examiner*—C. Fred Rosenbaum
*Assistant Examiner*—Sherri Vinyard
*Attorney, Agent, or Firm*—Clay Holland, Jr.

[57] ABSTRACT

An improved portable hair braider is provided which makes use of a plurality of hair grabbing members that extend transversely to the path of movement of the device over the top of the head. The invention hereof relates to the device described and claimed in U.S. Pat. No. 4,038,996, issued Aug. 2, 1977, to Eronini et al. The improvement hereof is specifically directed to a mechanical means for driving the ends of a plurality of grabbing members along a path in a plane perpendicular to their axes, wherein the path is defined as that of a figure eight. The hair grabbing members are caused to traverse or pass through a cross-over region formed by the intersection between two circular sections of the body of the device which is in the form of the figure eight.

The unique mechanical means for driving the hair grabbing members is accomplished by a plurality of rotatably moving paddles in intersecting and intermeshing relationship with a plurality of driven rudders which are at the remote ends of each of the grabbing members. The mechanical meshing relationship between the driving paddles and the driven rudders is designed to provide improved lateral rigidity between the paddles and rudders as the rudders pass through the cross-over region from one half of the figure eight pathway to the other half thereof. In the prior art device cited above significant looseness, hesitation or the like in the movement of the mechanical means may be experienced as the geared arrangement passes through the cross-over region of the device. The structural features and operational aspects of the present device overcome such prior art problems and difficulties to thereby provide a more efficient and smoother operating device having enhanced rigidity between the moving parts at points along the path traversed, which are characterized and recognized as somewhat critical to satisfactory operation of the prior art device.

1 Claim, 6 Drawing Figures

HAIR BRAIDER

SUMMARY OF THE INVENTION

An object of my invention is to provide an improved portable hair braider device, which can be used as a tool for braiding and weaving hair or like material. Novel means is provided to insure the lateral rigidity needed between the driving mechanisms and the driven hair grabbing members of the device, as they pass through or traverse the cross-over point or region in a figure eight pattern formed by two intersecting circular sections along the path which the ends of the grabbing members travel, perpendicular to their axes, while performing their braiding or weaving operations.

The braiding or weaving functions are performed by the use of at least three grabbing members as they are rotatably moved along a structural path in the body of the device which is defined as having the configuration of a figure eight. The unique shape or configuration of the ends of each grabbing member, or the rudder as they have been designated, are designed and constructed to intermesh with a corresponding plurality of driving members, designated paddle members, having spaced apart extensions associated therewith which cause the rudders to move smoothly along the pathway defined by the figure eight and passes through the cross-over point or region of the two halves of the figure eight smoothly without any significant hesitation or looseness while making each transitional pass through the cross-over region. In this manner the operation of the device is substantially enhanced and overcomes the problems and difficulties of the prior art device cited hereinabove.

DESCRIPTION OF THE PREFERRED EMBODIMENT

Figure 1:
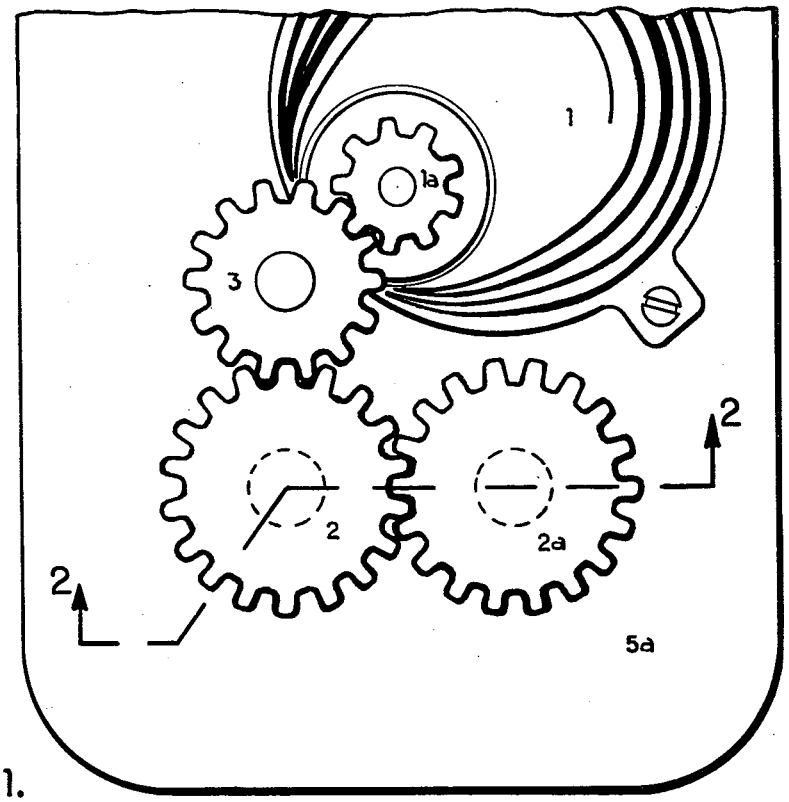
FIG. 1 is a top plan view of a portion of the device showing a source of driving power therefor and the transmission of such power by gears to operate the device.
Figure 2:
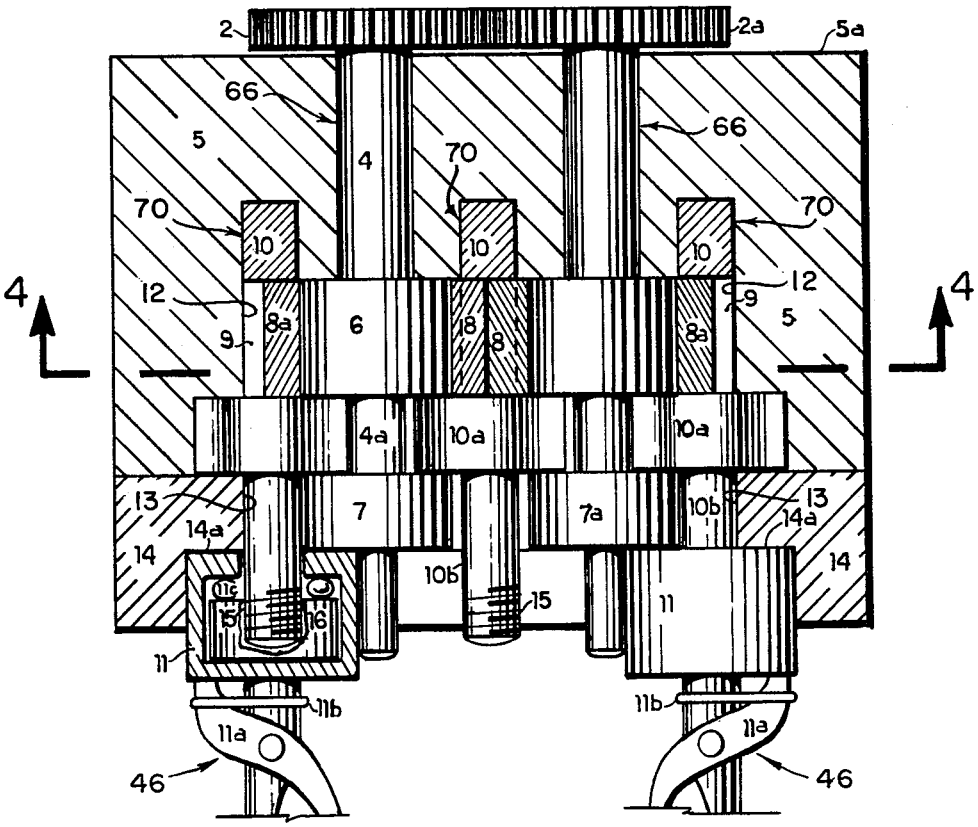
FIG. 2 is an enlarged vertical section through the device taken along section line 2—2 of FIG. 1.
Figure 5:
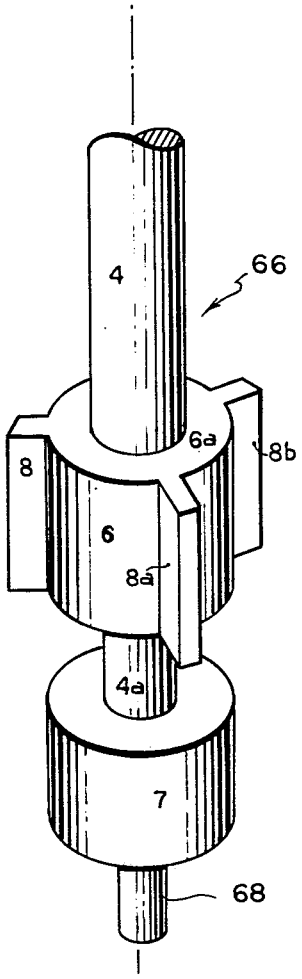
FIG. 5 is a perspective view of portions of a paddle driver.

Referring now to the figures wherein the preferred embodiment of the invention is shown. In FIG. 1 a motor 1 for driving the entire device is shown, having a small gear 1*a* which drives a spur gear 3 that in turn drives first and second drive gears 2 and 2*a*, respectively providing rotational power for the device. As shown in FIG. 1 drive gears 2 and 2*a* are identical and rotate in opposite directions. FIG. 2 illustrates that gears 2 and 2*a* are each attached to the upper end of a pair of large shaft sections 4. Shaft section 4 is an integral part of a paddle driver device generally designated 66 illustrated in FIG. 5. As shown in FIG. 5 each paddle device 66 includes large shaft 4; a paddle cylinder segment 6 connected to shaft 4 having three elements 8, 8*a* and 8*b* connected thereto and disposed 120 degrees apart around the circumference of segment 6 and extending horizontally outward therefrom; a small lower shaft section 4*a* extending vertically from segment 6; a second cylindrical section 7 connected vertically to shaft 4*a* and a small lower shaft section 68 connected vertically to section 7, 7*a* is the designation for the section on a second paddle when used.

Figure 3:
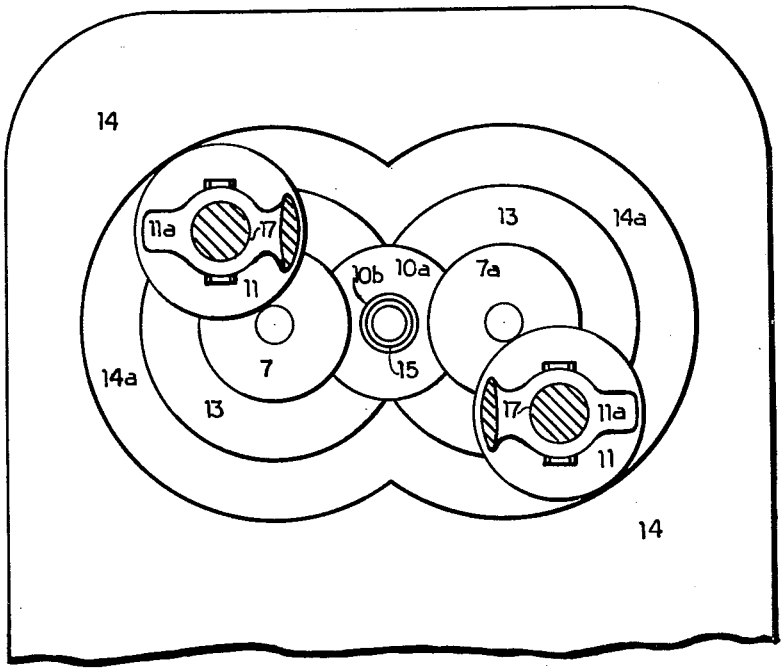
FIG. 3 is a bottom plan view of a portion of the device showing the circular cam groove in the form of a figure eight.
Figure 4:
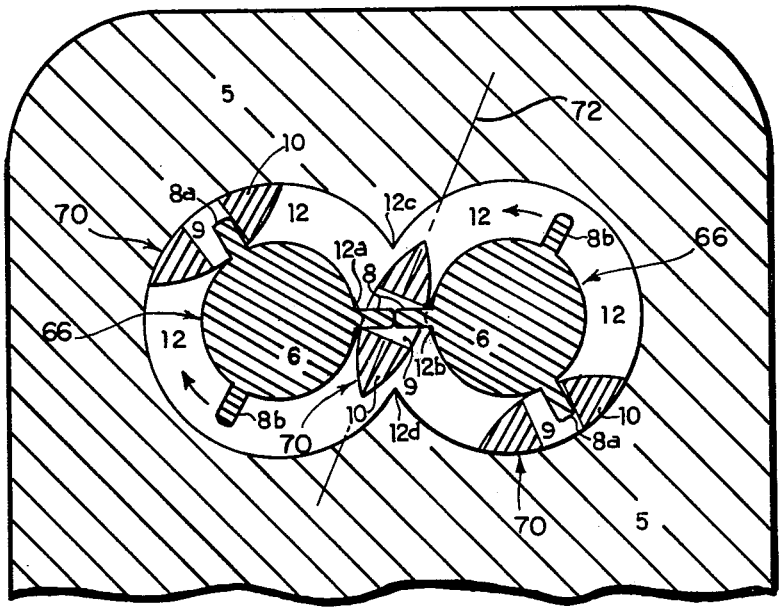
FIG. 4 is a horizontal section through a portion of the device and is taken along the section line 4—4 of FIG. 2, and illustrates the cross-sections of the figure eight groove, the rudder ends of the hair grabbing members and the unique intermeshing mechanism between the rudder and the engaging paddles.

FIGS. 2, 3 and 4 illustrate the relative positions of the two paddle driver devices 66 with respect to opening 12 in an upper body member 5 and opening 13 in a lower plate 14. Both openings 12 and 13 are shown as being formed by the intersection of two circular arcs of the structure of the device to thereby form a figure eight configuration within the structures of upper body 5 and lower plate 14. The paddle devices 66 are also shown as engaging a plurality of rudder driven devices 70.

Figure 6:
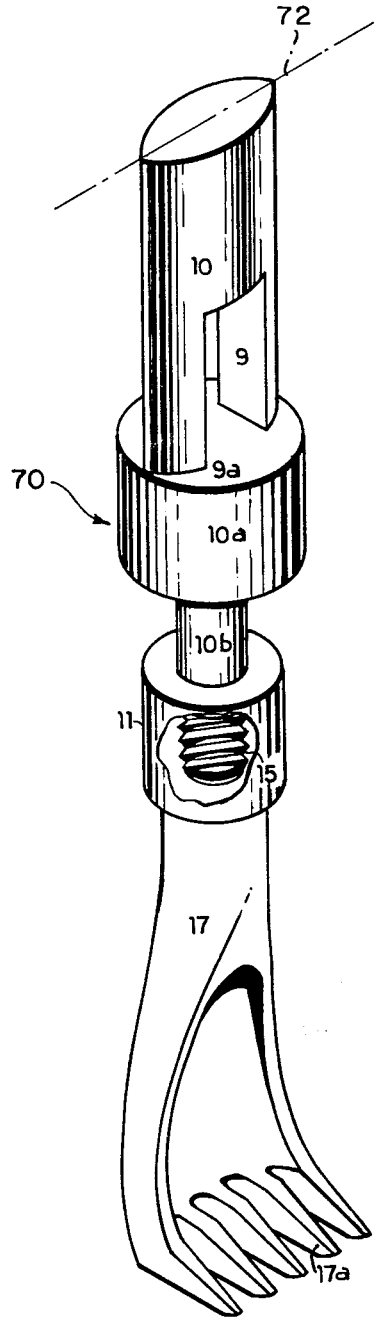
FIG. 6 is a perspective view of a hair grabbing member with the rudder end illustrating that element of the device.

Referring now to FIG. 6 the detailed construction of driven rudder device 70 is shown. Device 70 includes a rudder section 10 whose shape is defined as having an oval-like or elongated cross-sectional area formed by the intersection of two arcs of circles about a center line 72 therebetween, said arcs having the same radius of curvature as each half of figure eight openings 12. The cross-section of rudder section 10 has a length greater than the distance between two points 12*c* and 12*d* of openings 12 and are formed by the intersecting outer edges of the radius of curvatures of each of the halves of openings 12. Rudder section 10 has a slot therein which receives paddle elements 8, 8*a*, or 8*b* in an intermeshing manner during the operation of the device. Connected to the lower end of rudder section 10, to which a small cylindrical section 10*b* is connected. The lower end of section 10 is connected to a hair grabbing member 17 by appropriate means. Hair grabbing member 17 includes a plurality of teeth-like elements 17*a*, which complete rudder device 70 shown in FIG. 6.

A more complete understanding of the inventive features of the present device can be seen by referring to FIGS. 2 and 4 and by a discussion of the space relationship of the various elements and components along with the manner in which they cooperate to provide an improved device. As shown in FIG. 2 the major components body 5, a pair of paddle driver devices 66 and three rudder driven devices 70 are shown. As shown a pair of prior art hair clamping or grabber members 46 are connected to the lower end section 10*b* and do not constitute a part of the present invention. However, their presence illustrates that other means may be used for holding the strands of hair while the braiding process is performed. The use of grabbing members 17 with teeth 17*a* have been found to be advantageous for purposes of the present invention.

Continuing with the description and operation of the present invention, reference is now made to FIG. 4, where the unique driving action of the invention is most clearly illustrated.

As shown in FIG. 4 two paddle driver devices 66 are in intermeshing relationship with the slot ends of three rudder driven devices 70. Particular attention should be given the rudder 70 which is disposed at the cross-over point or region between points 12*c* and 12*d*, at the intersection between the two circular half sections of openings 12 that form a pathway having a figure eight configuration.

As shown in FIG. 4, one paddle element 8 from both paddle devices 66 extend into slot 9 of rudder device 70. It can be seen that the paddle 66 at the left is in firm contact and driving motion with the lower left hand edge of slot 9, while the paddle 66 at the right is in momentary contact with an upper edge of slot 9. It should be noted that paddle elements 8 of the respective paddle drivers are in substantially firm contact with the rudder slot at all times. Stated differently, the rudders are under control of the paddles at all times when they are nearing, in or passing through the cross-over point of the device.

In this mode of operation, it has been found that the motion of the rudders is not impeded as they pass through the cross-over region, contrary to the experiences encountered in the prior art devices cited herein above.

The present driving arrangement along with the method and means for transferring rotational motion or travel along the figure eight grooved pathway of openings 12 in the body 5 of the device is rendered smooth without heretofore attendant hesitation or lack of lateral rigidity when prior art gear arrangements are utilized. Thus, the present novel configuration of the rudder has been adapted to accomodate the figure eight configuration of the body of the device and to intermesh with the paddle device to provide a significant improvement in the operation of the hair braider device. The twisting motion for the grabbing members 17 is accomplished by the figure eight motion experienced by the rudder travelling along groove 12. As a rudder is driven by the paddle element on the left side of the device they follow a counter-clockwise motion and as they pass through the crossover point and are driven by the paddle element on the right of the device, they are driven clockwise.

The operation of the device is commenced by stroking segments of hair with the rudder attachment 17 and teeth 17*a* to thereby selectively hold and weave hair segments into braids adjacent to a human head in the form of corn rows adjacent the scalp or as braids as the device braids the hair as it is moved further and further from the scalp.

It is to be understood that the above described embodiment is only illustrative of the principles applicable to the invention. Numerous other arrangements and modifications may be defined by those skilled in the art without departing from the spirit and scope of the invention.

I claim:

1. In a hand held hair braiding device including a housing with a bottom section, an intermediate section, and a top section in spaced arrangement, said bottom section including a plurality of hair parting members extending at right angles from beneath said bottom section, said intermediate section including a figure eight shaped, opening therethrough formed by the intersection of two substantially identical circular openings further including a ledge formed near the bottom thereof and extending perpendicularly away from the wall of opening, said top section including two circular openings spaced to be centered above each of said two circular openings of said intermediate section;

two drive shafts each arranged to extend through said openings in said top section wherein each of said drive shafts includes a drive gear which extends above and is larger in diameter than each of said openings in said top section, and driving means extending from said drive shaft a distance not to exceed the radius of said circular openings in said intermediate section and spaced a distance down said shaft from said drive gear to correspond with the openings in said intermediate section;

a plurality of hair grabbing members each including a top portion and a hair gripping portion wherein, said hair gripping portion is connected to said top portion, said top portion includes a coupling means cooperating with said driving means, said top portion is held in interengaging relation with said driving means by said wall and said ledge, said hair gripping portion including means for retaining hair as it is parted by said parting members;

and a motor disposed in opposite driving relation to each of said gears so that when the motor is operated, said drive shafts and said driving means are rotated in opposite directions to move said hair members in the path of a figure eight as defined by said figure eight opening, causing each of said parted hair sections retained by said hair gripping portion to be interwoven with each other to form a tight braid;

the improvement comprising:

said driving means comprises three equally spaced paddle like elements extending radially from said drive shaft, said hair grabbing member each include an oval shaped top portion defined by two intersecting arcs having the same radius of curvature as that of said circular openings in said intermediate section, and said coupling means includes a rectangular slot shaped to receive in succession each of said paddle like elements as said paddle like elements are rotated by said drive shaft.

* * * * *